United States Patent [19]

Peters et al.

[11] Patent Number: 4,738,429

[45] Date of Patent: Apr. 19, 1988

[54] MANUALLY OPERATED CONTROL VALVE ON A PNEUMATIC DEVICE

[75] Inventors: Dieter Peters, Witten; Joachim Wiendahl, Dortmund, both of Fed. Rep. of Germany

[73] Assignee: J. D. Neuhaus Hebezeuge GmbH & Co., Witten, Fed. Rep. of Germany

[21] Appl. No.: 879,622

[22] Filed: Jun. 27, 1986

[30] Foreign Application Priority Data

Feb. 21, 1986 [DE] Fed. Rep. of Germany ... 8604725[U]

[51] Int. Cl.[4] ..... F15B 13/04

[52] U.S. Cl. ..... 251/110; 251/294; 464/88

[58] Field of Search ..... 251/90, 109, 110, 231, 251/293, 294; 74/104, 501 R, 543, 470, 545, 598, 599, 547; 464/88, 181, 183

[56] References Cited

U.S. PATENT DOCUMENTS

| | | | |
|---|---|---|---|
| 2,409,385 | 10/1940 | Pletcher | 464/88 X |
| 2,870,468 | 1/1959 | Barel | 464/88 X |
| 3,212,240 | 10/1965 | Walden | 464/88 |
| 3,285,288 | 11/1966 | Irwin et al. | 251/110 X |
| 3,596,875 | 8/1971 | Couper | 251/294 |
| 4,203,468 | 5/1980 | Dietz | 251/294 X |
| 4,274,445 | 6/1981 | Cooper | 251/104 X |
| 4,338,827 | 7/1982 | Hooker | 74/545 |

FOREIGN PATENT DOCUMENTS

| | | | |
|---|---|---|---|
| 40515 | 7/1932 | France | 251/110 |

*Primary Examiner*—A. Michael Chambers
*Assistant Examiner*—John C. Fox
*Attorney, Agent, or Firm*—Banner, Birch, McKie & Beckett

[57] ABSTRACT

The invention concerns a manually operated control valve on a pneumatically or hydraulically operated equipment which has a control shaft positioned substantially in a horizontally oriented direction. By turning the control shaft to and fro against an increasing resistance the attached motor of the equipment will turn in one direction or in the other direction. The control shaft is provided with a hose or a piece of hose together with an extension in the shape of a tube or the like, and the hose serves as a universal joint which retains its operating properties independently of any bending of the hose due to position changes of the equipment.

14 Claims, 1 Drawing Sheet

MANUALLY OPERATED CONTROL VALVE ON A PNEUMATIC DEVICE

BACKGROUND OF THE INVENTION

1. Field of the Invention

The present invention relates to a manually operated control valve on a pneumatically operated device, with an in particular horizontally positioned control shaft rotatable in one or the other direction against a rising resistance out of a neutral central position and with an operating member extending from the control shaft to floor or ground height.

2. Prior Art

Such control valves are particularly used on pneumatic lifting equipment operated by two control cables fixed to a rocker, the latter being fixed to the control shaft or spindle of the control valve. By pulling on one or the other cable, it is possible to controllably select the operating mode "raise" or "lower". Such cable controls are always required if the pneumatically operated equipment is outside the reach of the operator, i.e. is for example fixed to a roof beam or to a monorail facility.

In the case of a monorail mounting or gallows-like cantilever brackets, apart from the raising and lowering operation, it is often desirable to have a local displacement for which the lifting appliance is drawn on rollers along the monorail or along the brackets. This displacement is carried out manually with the aid of a cable which hangs from the pneumatic appliance and which is pulled or dragged in safety.

Such a cable control suffers from certain disadvantages. Despite a certain spacing being provided, there is a risk of the two operating cables becoming entangled. Moreover, in some cases operation can be made difficult or impossible if e.g. a pneumatic lifting appliance is used for a horizontal dragging movement or for a horizontally directed adjusting or positioning work. The cables then hang down vertically, but operation by merely pulling is made difficult or even impossible. Therefore, attempts have been made to replace the aforementioned cable control by bevel gears permitting the vertical bending of the control shaft on operating the pivot pin about the horizontal axis. A rod is provided on the now vertical operating member, which is attached to one bevel gear by means of a cardan joint and permits an actuation of the pneumatically operated equipment as a result of a rotary movement.

It has been found that the aforementioned difficulties cannot be overcome by bevel gears in the case of a horizontal action direction, e.g. of pneumatically operated lifting equipment. Thus, in such operating positions, the cardan joint virtually ceases to have any effect, so that a swinging rod brings about the operation of the pneumatically operated equipment. Thus, this solution cannot be satisfactory for safety reasons. In addition, the bevel gears must be given an extremely robust construction due to the tractive forces applied via the rod and this leads to correspondingly high costs.

OBJECTS OF THE INVENTION

Therefore the object of the present invention is to so modify a manually operated control valve of the aforementioned type that a floor-actuated operation of the pneumatically operated equipment is ensured, even in extreme operating conditions and undesired operation of the equipment is made virtually impossible.

SUMMARY OF THE INVENTION

According to the invention this problem is solved in that the actuating or operating member comprises a hose, for instance a rubber hose.

Similar to a cable, a hose has the feature of hanging down so as to follow gravity, independently of the direction in which the upper end points as a result of fixing or insertion. Furthermore, it also has the property of a certain rotary stability, so that a rotation of the free end is transferred to the fixed or inserted end. The invention makes use of this property of a hose.

For the realization of the present invention, it is sufficient for a relatively short hose portion of e.g. 15 cm to be provided between the control shaft of the manually operated control valve and a lengthening rod, on which the rotary actuation takes place as well as a pulling action along a rail. In place of a solid rod, it is obviously possible to use a tube, particularly one having a thin wall, because it is more a question of the lengthening action than the strength. Operation is facilitated by a grip at the end of a lengthening rod or at the end of the hose.

For the standard direction changes of e.g. pneumatic lifting equipment, a hose of a reduced quality is sufficient as an actuating member. In the case of pronounced position changes, a certain bending or buckling resistance must be ensured, because the advantageous effects of the hose would partly be eliminated by a kink therein. For these loads, it is therefore recommended to use a hydraulic hose which is made particularly stable to bending through fabric or wire inserts. In a conventional manner, such a hose is provided at its ends with pipe joints which constitute an ideal connection means for sleeves fitting thereto and split pins passed transversely through said union.

In particular, a high-quality hose provides all the requirements for e.g. making it possble to drag a pneumatic lifting equipment on the hose or a pipe serving as the extension along a rail. Due to the high strength of such hoses the necessary unity or connection is always ensured, so that there is no risk of damage or the like.

In the case of marked position changes, the controlability is retained in all circumstances. The hose or a hose portion with an extension in the form of a tube or rod, in all positions of the pneumatic apparatus automatically attempts to move into its hanging down position, where it is always rotatable. The complete area around the pneumatic apparatus serves as an unrestricted operating space, less the areas which are occupied by mounting supports, chains and the like. Thus, in the case of a corresponding design, it is important to note for a hose, that it remains fully operational as a rotary member, even if passed through an arc of 180°. Thus, even if the control shaft side provided with the hose end should point vertically upwards in a specific use, the hose or the tube or other extension fixed thereto hangs essentially laterally vertically, so that the actuating or operating possibility is fully retained. As a result of the invention, the difficulties occuring during operation or actuation according to the prior art are not encountered. There is neither a safety risk with a swinging hose, nor a position of the associated pneumatic apparatus in which the control would fail.

In view of government regulations and in general for increasing safety against unintentional operation, according to a further development of the invention the control shaft can have an unlockable catch or lock for arresting in its neutral position. In the case of such a construction, the hose or the tube or other extension fixed thereto can only be turned if said lock is unlatched. The lock can comprise a retractable bolt and a bore or recess, i.e. in the form of a conventional locking system with a pin, a latch or the like. Preferably the retractable bolt of the movable control shaft and the recess is associated with the control valve housing and the bolt is e.g. retractable with the aid of a cable or the like. It is particularly advantageous to use a construction in which the bolt is spring-loaded and is unlockable with the aid of a Bowden cable and a hand lever. The hand lever is then located in the vicinity of the hose or tube and close to a handle or slightly above the same. As a function of the skill of the operator, unlocking and turning can take place with one hand, or alternatively unlocking can take place with one hand and turning with the other.

BRIEF DESCRIPTION OF THE DRAWINGS

Other and further objects of the present invention will be apparent from the following description and claims and are illustrated in the accompanying drawings, which by way of illustration schematically shows a preferred embodiment of the present invention and the principle thereof and what now is considered to be the best mode contemplated for applying this principle. Other embodiments of the invention embodying the same or equivalent principles may be used and structural changes may be made as desird by those skilled in the art without departing from the present invention and the scope of the appended claims. The drawings show:

DETAILED DESCRIPTION OF THE EMBODIMENT

Figure 1:
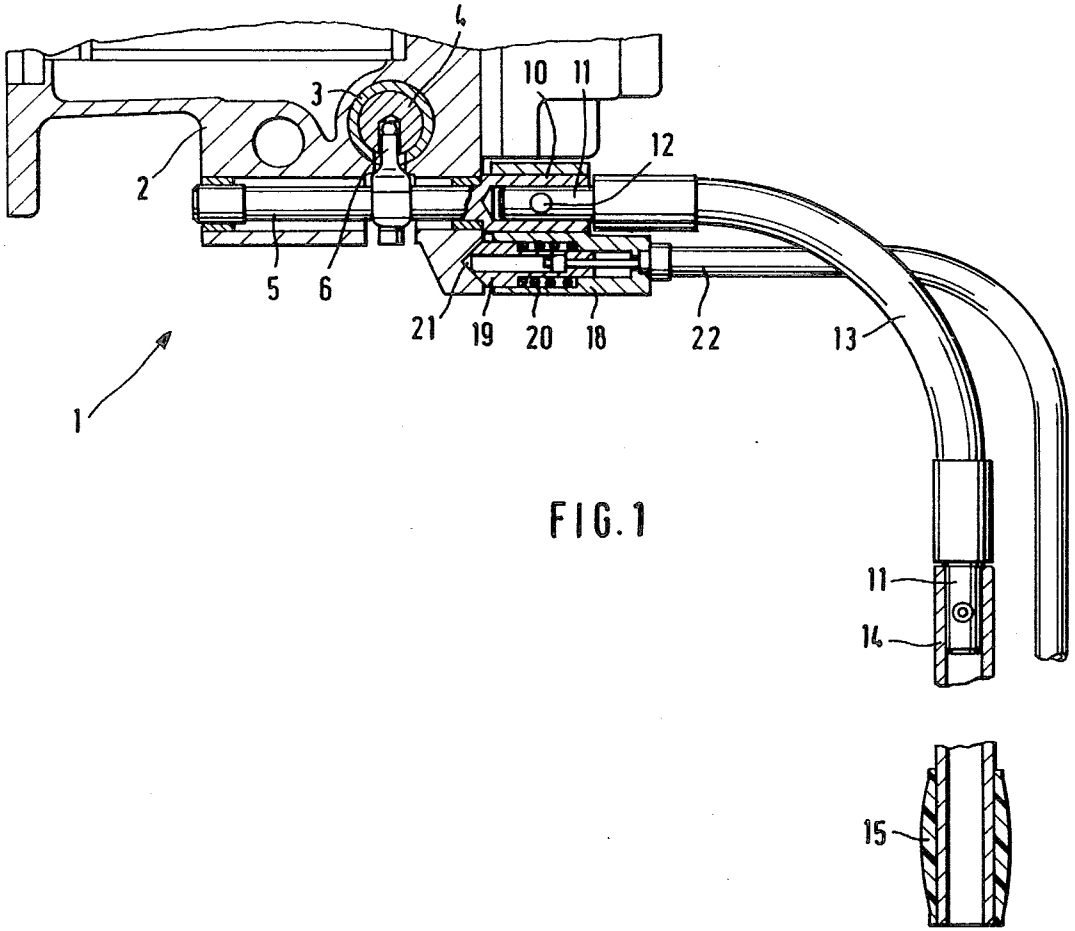
FIG. 1—a cross-sectional view through a control valve with an actuation system according to the invention, FIG. 2—a view of the lower end of the actuating member with a hand lever for unlocking an actuating lock or catch.

In FIG. 1 there is shown the lower part of pneumatic lifting equipment 1, into whose casing 2 is integrated a manually operated control valve. Within a sleeve 3 a control piston 4 can be reciprocated in one or the other direction from a neutral central position, the direction of movement passing vertically through the plane of FIG. 1. Within control piston 4 is provided a bore, in which engages an actuating finger 6 mounted on a control shaft 5. Thus, through pivoting control shaft 5, the pneumatic lifting equipment 1 is put into operation in one or the other direction. Control piston 4 is centred with the aid of not shown springs, so that the control shaft 5 always returns to the starting position if no external forces act on it. Reference is made to U.S. Pat. No. 4,515,183.

One end of the control shaft 5 is shaped to form a sleeve 10, into which is fitted a pipe joint 11. Sleeve 10 and pipe joint 11 are immovably fixed together with the aid of a split pin 12. Pipe joint 11 forms one connection of hose 13, whose other end has the same design and is fixed to a tube 14. Tube 14 is made from steel, plastic or a light metal alloy and can optionally be extended with the aid of screw bushes, plug connections or the like. Normal tube lengths are 1 to 3 m. A handle 15, which facilitates the operation of the control, is located at the lower end of the tube.

Hose 13 acts as a flexible rotary connection from the central axis of tube 14 to the central axis of control shaft 5. Due to its flexibility with respect to the bending, but natural rigidity with respect to torsion, any rotary movement transmitted from tube 14 to control shaft 5 is independent of the bending state of hose 13.

Figure 2:
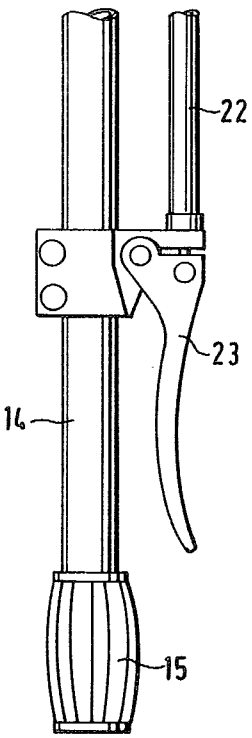

A bolt housing 18 is clamped on to sleeve 10 of control shaft 5 and follows the movements of sleeve 10 and consequently control shaft 5. In the lower part of bolt housing 18 is located a bolt 19, which can be moved with the aid of a spring 20 in the direction of a recess 21 in casing 2 of lifting equipment 1. Bolt 19 is provided with a stepped bore and the thickened portion of the core of a Bowden cable 22 engages on the step. The lower part of the Bowden cable 22 is shown in FIG. 2. A rest for the spiral of Bowden cable 22 connected to tube 14 is provided in the manner of a bicycle hand brake, whilst the cable core is anchored on a hand lever 23. By operating hand lever 23, the bolt 29 is retracted within the bolt housing 18 and consequently a locking effect between the bolt tip and recess 21 is discontinued.

As a result of the diameter choice of bolt 19 and the size of recess 21, with hand lever 23 released, there is an additional centering action due to the conical shape of the two mating surfaces on the bolt tip and in the recess 21. This increases the security against any lagging of the lifting equipment 1 in the case of a suddenly released actuating member. Any wear on the bolt tip and within recess 21 is automatically compensated due to the conical surface. The opening angle of the conical surfaces is chosen in such a way that there can be no automatic overcoming of the lock or catch in the case of an extreme rotary force on control shaft 5.

What is claimed is:

1. A manually operated control valve for pneumatically or hydraulically operated equipment comprising a horizontally positioned control shaft connected to operate said valve upon rotation of said control shaft, said control shaft being rotatable in one or the other direction against increasing resistance when said shaft is rotated from a neutral position;

an actuating member extending axially from said control shaft and connected thereto to effect rotation of said control shaft upon rotation of said actuating member, said actuating member including a length of flexible hose having one end adjacent said control shaft whereby said flexible hose curves downwardly relative to the axis of said horizontally positioned control shaft to provide a depending free end of said actuating member remote from said control shaft and disposed in a position to be grasped and turned by an operator, thereby transmitting rotation through said flexible hose while permitting said actuating member to hang downwardly freely independently of the angular orientation of said actuating member and said control shaft.

2. Manually operated control valve according to claim 1, characterized in that a rod-like member (14) is fixed to the free end of hose (13).

3. Manually operated control valve according to claim 2, characterized in that said control shaft is constructed with a sleeve (10) at the end facing said actuating member, said hose (13) being provided at its ends with pipe joints (11), each said pipe joint (11) being fixed with the aid of a pin member (12) passing through said sleeve (10) and pipe joint (11) and through said rod-like member (14) and said pipe joint (11).

4. Manually operated control valve according to claim 2, characterized in that said hose (13) is approximately 15 cm long.

5. Manually operated control valve according to claim 2 characterized in that the control valve (5) has an unlockable catch (19,21) for arresting in its neutral position.

6. Manually operated control valve according to claim 5, characterized in that said catch comprises a retractable bolt (19) and a recess (21).

7. Manually operated control valve according to claim 6, characterized in that said retractable bolt (19) is associated with said actuating member (13) and said recess (21).

8. Manually operated control valve according to claim 7, characterized in that said bolt is retractable with the aid of a Bowden cable (22).

9. Manually operated control valve according to claim 8, characterized in that a handle (15) is fixed to the free end of said actuating member and that said Bowden cable (22) is connected to a hand lever (23) in the vicinity of said handle (15).

10. Manually operated control valve according to claims 1 or 2, characterized in that a handle (15) is fixed to the free end of said actuating member.

11. Manually operated control valve according to claim 1, characterized in that the hose (13) is a hydraulic hose.

12. Manually operated control valve according to claim 11 characterized in that said hydraulic hose is provided with several reinforcing inserts.

13. Manually operated control valve according to claim 1, characterized in that the hose (13) is provided at its ends with pipe joints (11), said joints being held in the hose ends by conventional clamping sleeves.

14. Manually operated control valve according to claim 13, characterized in that the control shaft is constructed as a sleeve (10) at the end facing said actuating member, each said pipe joint (11) being fixed with the aid of a pin-like member passing through said sleeve (10) and pipe joint (11).

* * * * *